United States Patent [19]

Clark et al.

[11] Patent Number: 4,666,621

[45] Date of Patent: May 19, 1987

[54] PRE-MOISTENED, STREAK-FREE, LINT-FREE HARD SURFACE WIPING ARTICLE

[75] Inventors: William A. Clark, Clifton; David Pregozen, Park Ridge, both of N.J.

[73] Assignee: Sterling Drug Inc., New York, N.Y.

[21] Appl. No.: 847,352

[22] Filed: Apr. 2, 1986

[51] Int. Cl.[4] ..... A47L 1/15; B08B 1/00; C11D 17/00; C11D 17/04

[52] U.S. Cl. ..... 252/91; 15/104.93; 15/209 R; 15/214; 15/220 R; 252/170; 252/174; 252/551; 252/DIG. 10; 428/227; 428/245; 428/252; 428/260; 428/272; 428/288; 428/289; 428/290; 428/340; 428/341

[58] Field of Search ..... 15/104.93, 209 R, 214, 15/220; 106/13; 252/91, 170, 174, 551, DIG. 10; 428/227, 245, 252, 260, 272, 288, 289, 290, 340, 341

[56] References Cited

U.S. PATENT DOCUMENTS

| | | | |
|---|---|---|---|
| 2,288,714 | 7/1942 | Jones | 15/209 |
| 3,075,228 | 1/1963 | Elias | 15/506 |
| 3,335,449 | 8/1967 | Faessinger | 15/506 |
| 3,897,356 | 1/1975 | Pociluyko | 252/91 |
| 4,096,311 | 6/1978 | Pietreniak | 428/289 |
| 4,181,769 | 1/1980 | Plamondon | 428/253 |
| 4,189,395 | 2/1980 | Bland | 252/91 |
| 4,239,792 | 12/1980 | Ludwa | 428/198 |
| 4,276,338 | 6/1981 | Ludwa | 428/137 |
| 4,287,251 | 9/1981 | King | 428/198 |
| 4,319,956 | 3/1982 | Snyder | 162/146 |
| 4,328,279 | 5/1982 | Meitner | 428/289 |
| 4,343,725 | 8/1982 | Kiewert et al. | 252/542 |
| 4,381,246 | 4/1983 | Anderson | 252/91 |
| 4,411,928 | 10/1983 | Baldwin | 427/2 |
| 4,442,161 | 4/1984 | Kirayoglu | 428/219 |
| 4,448,704 | 5/1984 | Barby et al. | 252/91 |
| 4,467,013 | 8/1984 | Baldwin | 428/289 |
| 4,533,399 | 8/1985 | Mencke | 134/6 |
| 4,600,620 | 7/1986 | Lloyd | 428/195 |
| 4,606,958 | 8/1986 | Haq | 428/68 |

FOREIGN PATENT DOCUMENTS

| | | |
|---|---|---|
| 1523740 | 9/1978 | United Kingdom . |

*Primary Examiner*—Dennis L. Albrecht

*Attorney, Agent, or Firm*—Frederik W. Stonner; Paul E. Dupont

[57] ABSTRACT

A pre-moistened wipe for cleaning hard surfaces to a shiny, substantially streak-free and lint-free finish comprising a flexible substrate of a mechanically bonded nonwoven material containing wood pulp and synthetic fibers having incorporated therein a low level of an acrylic polymer and impregnated with a liquid cleaning solution having a surface tension less than 40 dynes/cm and comprising an anionic, nonionic, cationic, zwitterionic or amphoteric surface active agent, a monohydric aliphatic alcohol of 1 to 6 carbon atoms and demineralized water.

14 Claims, No Drawings

PRE-MOISTENED, STREAK-FREE, LINT-FREE HARD SURFACE WIPING ARTICLE

BACKGROUND OF THE INVENTION

1. Field of the Invention

The invention relates to a wiping article for use in cleaning soiled hard surfaces, more particularly to a wiping article including a flexible substrate incorporating a liquid cleaner for removing soils from hard, normally shiny surfaces without substantial linting or streaking.

2. Information Disclosure Statement

Various liquid compositions have been described which were designed particularly for the cleaning of hard surfaces without streaking or spotting.

Exemplary of such liquid cleaning compositions are those described in British Pat. No. 1,523,740 comprising a mixture of certain detersive sulfates and sulfonates, a builder salt, a suds depressant and water, for cleaning hard surfaces, particularly shiny, glassy or vitreous and metal surfaces and which do not require additional wiping or cleaning; and aqueous based cleansers described in U.S. Pat. No. 4,343,725 comprising a certain polymer, a surfactant and water, for cleaning glass surfaces and which dry to a streak-free condition.

There have also been described various hard surface wiping articles comprising substrates having incorporated thereon or therein certain surface treating agents or cleansing agents. Such wiping articles, included among which are those specifically designed to give streak-free results, are provided either in (a) dry form and intended for use in the dry state, or (b) dry form and intended to be used in conjunction with moisture, or (c) wet-impregnated form intended for use without the need for providing additional moisture.

Exemplary of wiping articles of type (a) above are those described in U.S. Pat. Nos. 2,288,714 and 3,075,228. U.S. Pat. No. 2,288,714 describes a cleaning and anti-mist film applying article for dry cleaning glass surfaces comprising a flexible substrate such as soft tissue paper or cloth, containing a minute amount of an anti-mist agent which permits cleaning and anti-misting treatment of a glass surface in a single operation, the anti-mist agent being distributed in spaced areas on the substrate. U.S. Pat. No. 3,075,228 describes an anti-fogging article comprising a flexible web-like fabric such as paper, felt and textile containing, as the active agent, an alkali metal salt of a sulfated alkyl aryloxypolyalkoxy alcohol.

U.S. Pat. No. 3,897,356 describes a wiping article of type (b) above which comprises a wet strength paper towel impregnated with a certain nonionic surfactant which is used with moisture to clean glass surfaces without leaving a light defracting film.

U.S. Pat. No. 4,448,704 describes a wiping article of type (c) above for cleaning a hard surface, such as glass, to give a streak-free finish comprising a substrate, preferably paper or nonwoven fabric, carrying a homogeneous aqueous composition having a surface tension below 45 $mNm^{-1}$ and which on drying does not form discrete droplets or particles larger than 0.25 $\mu$m. A pre-wash of the substrate with a suitable solvent such as demineralized water or the impregnating solution in order to remove impurities which cause streaking is required to give streak-free performance.

SUMMARY OF THE INVENTION

Although the wiping article of U.S. Pat. No. 4,448,704, discussed above, is disclosed to provide for substantially streak-free cleaning of glass surfaces in one operation, it would be desirable to eliminate the need for pre-washing the substrate prior to impregnation thereof with the liquid cleaning composition while at the same time retaining the desired streak-free cleaning properties.

It was found during development of this invention that substantial streak-free cleaning of hard surfaces could be achieved by employing certain nonwoven fabric substrates comprising specific proportions of wood pulp fibers and synthetic fibers which are mechanically rather than chemically bonded, impregnated with an appropriate liquid cleaning composition. However, it was further found that although such mechanically bonded nonwoven fabrics performed satisfactorily not only with respect to providing a substantially streak-free finish but also other properties such as wet strength, hand and absorbency, abrasion of the substrate during the wiping operation led to an undesirable degree of linting. It was subsequently suprisingly discovered that by employing a mechanically bonded nonwoven fabric substrate which has been treated with a critical amount of certain acrylic polymer binders significantly less than that required for the chemical bonding of fibers in conventional methods for producing chemically bonded nonwoven fabrics, linting due to abrasion was substantially avoided without adversely affecting either streak-free perfomance, hand or absorbency.

Thus the invention provides a pre-moistened wipe for cleaning a hard surface to a shiny, substantially streak-free and lint-free finish, the pre-moistened wipe comprising a flexible substrate carrying a liquid cleaning composition wherein:

(a) the flexible substrate comprises a mechanically bonded nonwoven fabric comprising from about 30 to about 60 percent by weight of wood pulp fibers and from about 70 to about 40 percent by weight of synthetic fibers and having incorporated therein an acrylic polymer;

(b) the liquid cleaning composition has a surface tension of less than 40 dynes/cm and comprises from about 0.001 to about 1 percent by weight of a surface active agent, from about 1 to about 40 percent by weight of a monohydric aliphatic alcohol having from 1 to 6 carbon atoms, and from about 60 to about 99 percent by weight of demineralized water; and (c) the amount of acrylic polymer incorporated in the nonwoven fabric is from about 0.225 to about 2.25 percent by weight of the untreated substrate.

DETAILED DESCRIPTION OF THE INVENTION INCLUDING THE PREFERRED EMBODIMENTS

The pre-moistened wipes of the invention provide for high performance cleaning of soiled hard surfaces with extremely low deposition of residuals. They are especially useful for the cleaning of lightly soiled surfaces such as windows, mirrors and countertops to a shiny, substantially streak-free and lint-free condition. They are particularly designed for one-step cleaning, that is, the soiled surface need only be wiped with the pre-moistened wipe and allowed to air dry thus obviating the need for messy spraying or cumbersome and time consuming rinsing and subsequent drying with cloths or paper towels.

The pre-moistened wipe of the invention comprises a flexible substrate comprising a nonwoven fabric which has been treated with a small amount of a polymeric material and wet-impregnated with a liquid cleaning composition.

The flexible substrate is comprised of a mechanically bonded nonwoven material having good wet-strength. The nonwoven material is a combination of wood pulp fibers and textile length synthetic fibers formed by well known dry-form or wet-lay processes. Mechanical bonding is achieved by standard techniques such as thermo-bonding and spunlaced bonding. Synthetic fibers such as rayon, nylon, orlon and polyester as well as blends thereof can be employed. The wood pulp fibers should comprise about 30 to about 60 percent by weight of the nonwoven fabric, preferably about 55 to about 60 percent by weight, the remainder being synthetic fibers. The wood pulp fibers provide for absorbency, abrasion and soil retention whereas the synthetic fibers provide for substrate strength and resiliency.

Nonwoven fabrics, the fibers of which have been bonded by standard chemical bonding processes, are to be avoided because at the levels of chemical binder employed in such processes a sufficient amount thereof is extractible and therefore will result in streaking.

In a preferred nonwoven material, mechanical bonding is achieved by a spunlaced process in which a fibrous web is subjected to high-velocity water jets that entangle the fibers. The nonwoven material then is subjected to conventional drying and wind-up operations.

The substrate is in the form of a flexible sheet or pad which has been treated with a low level of an acrylic polymer binding agent described hereinbelow. The acrylic polymer treatment is essential to prevent linting which otherwise would result due to abrasion during the cleaning operation.

The amount of acrylic polymer used to treat the nonwoven material is critical. Thus a balance must be struck between an amount that will prevent linting due to abrasion thereby providing for substantial lint-free cleaning performance, and that which would adversely affect streak-free cleaning and such properties as flexibility, absorbency and good hand. The amount of acrylic polymer which is employed, i.e., the solids add-on, is from about 0.225 to about 2.25 percent based on the weight of the nonwoven material. While somewhat higher amounts may be used, no further advantage against linting is gained. Preferably an amount of acrylic polymer in the range of about 0.315 to about 0.9 percent is employed, more preferably 0.315 to 0.585 percent.

The nonwoven material employed in the pre-moistened wipe of the invention preferably has a base weight in the range of about 1.6 to about 3.0 oz/yd$^2$. When in sheet form, the dimensions of the substrate conveniently are about $10\times7\frac{1}{2}$ inches (approx. $25\times20$ cm).

A suitable nonwoven material is modified Sontara® 8801, a spunlaced fabric containing a blend of 60% wood pulp fibers and 40% polyester fibers and having a unit weight of 1.85 oz/yd$^2$ (approx 62.7 g/m$^2$), prepared by producing a polyester fiber backbone by an air-lay process and laminating thereto a sheet of wood pulp fibers by water-needling thereby entangling the polyester and wood pulp fibers. This material is available from E.I. Du Pont de Nemours & Company.

A critical ingredient of the pre-moistened wipe of the invention is the acrylic polymer employed to treat the nonwoven fabric material so as to suppress linting during a cleaning operation. The acrylic polymers are copolymers of monomeric acrylic esters such as ethyl acrylate, butyl acrylate and/or methyl methacrylate, optionally in combination with such functional monomers as styrene. These polymers are commercially available in the form of emulsions containing the acrylate blend, emulsifier and water, the solids content of which is comprised predominantly of the acrylic polymer. However, not all such acrylic polymer emulsions are suitable for use in this invention, there being those which, when used at the levels at which suitable acrylic polymer emulsions are employed in the invention, do not perform satisfactorily with respect to linting and/or streaking and in some cases even adversely affect other desirable properties such as hand. Acrylic polymer emulsions which have been found to be suitable in practicing this invention are those which are characterized as being hydrophobic or slightly hydrophobic. Acrylic polymer emulsions which are characterized as being hydrophilic were found to have a tendency to cause streaking and therefore are unsuitable. Furthermore the acrylic polymer emulsion must meet a certain relative parameter of film stiffness. This parameter, designated in the industry as $T_{300}$, is the temperature at which the torsional modulus of an air-dried film of the acrylic polymer is 300 kg/cm$^2$. The $T_{300}$ should be less than 0° C. Acrylic polymers having a $T_{300}$ of less than 0° C. do not embrittle the substrate but rather provide soft to very soft finishes which tend to be more yielding thus allowing for substantial lint reduction.

The nonwoven material is treated with the acrylic polymer emulsion using standard processes and equipment. The following sequential steps are exemplary of a process that can be employed:

1. The sheet of nonwoven material is passed through a dilute solution of the acrylic polymer emulsion to which has been added minor amounts of catalyst and appropriate formulation aids such as are well known in the art, e.g. a foam suppressant.

2. The nonwoven material from step 1 then is passed between rollers calibrated to squeeze off an amount of the dilute solution in excess of that required to provide a desired solids add-on level to the nonwoven material in the range of from about 0.225 to about 2.25 percent based on the dry weight of the nonwoven material;

3. The nonwoven material from step 2 is then passed through a curing oven, such as a hot air induction oven, the temperature of which preferably is in the range of about 300° F. to about 450° F., most preferably 350° F. to about 400° F., the exposure time of the treated nonwoven material to these temperatures being sufficient to effect proper curing.

The oven exposure time should generally be from about 10 to about 20 seconds and oven temperatures substantially in excess of 450° F. or lower than 300° F. should be avoided. Excessive temperature and/or exposure time can lead to too much curing which could result in injury to the substrate, particularly reduction in substrate absorbency. On the other hand, too short an exposure time and/or too low a temperature can result in inadequate curing which could lead to re-emulsification and subsequent leaching of the unbound acrylate into the liquid cleaning solution with which the substrate is to be impregnated in accordance with the invention, thus inducing streaking.

Suitable acrylic emulsion polymers are EMULSION E-940, a soft, anionic, self-cross linking acrylic emulsion having a solids content of 45% and a $T_{300}$ (measured) of −20° C., and RHOPLEX® TR-934 having a solids content of 44.5% and a $T_{300}$ of −30° C., both polymers available from Rohm and Haas Company.

The liquid cleaning composition with which the wipe of the invention is pre-moistened is comprised of three essential components: an alcohol, a surface active agent and demineralized water. The combination of the essential components should provide a liquid composition having a surface tension less than 40 dynes/cm.

The alcohol is a monohydric aliphatic alcohol having from one to six carbon atoms such as methanol, ethanol, isopropanol and hexanol. The alcohol contributes to good solvency of polar and non-polar soils and an acceptable evaporation rate and decreases surface tension. The amount of alcohol employed should be from about 1 to about 40 percent by weight of the three essential components of the composition, preferably from about 10 to about 30 percent and most preferably from about 15 to about 25 percent. A preferred alcohol is ethanol.

The surface active agent can be selected from anionic, nonionic, cationic, amphoteric or zwitterionic surfactants and compatible mixtures thereof. It should have the following characteristics when employed in concentrations according to the invention: low foaming, low streaking tendency, good detergency and dispersion of oily and particulate soils, and good wetting of hard surfaces such as glass, chrome, formica and porcelain. Surface active agents having these characteristics are well known to those skilled in the art. Particularly applicable and preferred are anionic surface active agents such as soaps, alkyl sulfates and sulfonates and alkyl ether sulfates, and nonionic surface active agents such as alcohol ethoxylates, ethoxylated alkylphenols and polyoxyethylene polyoxypropylene block polymers. Also applicable are fluorosurfactants which may be of the anionic, nonionic, cationic or amphoteric type, and silicone surfactants.

Suitable anionic surface active agents include those selected from:

(a) ordinary alkali metal soaps of higher fatty acids having from about 8 to about 24 carbon atoms;

(b) alkyl sulfonates and sulfates wherein the alkyl is straight or branched and has from about 8 to about 24 carbon atoms and the cation is water-soluble, e.g., alkali metal and ammonium;

(c) sodium alkyl glyceryl ether sulfonates; and (d) alkyl ether sulfates of the formula $RO(C_2H_4O)_n$-$SO_3M$ wherein R is alkyl or alkenyl having from about 10 to about 20 carbon atoms, n is 1 to 30 and M is a water-soluble cation, e.g., alkali metal and ammonium.

Anionic surfactants of type (d) above are marketed by Shell Chemical Company under the trademark Neodol®, e.g., Neodol®25-3S which is a sulfated alkyl ether wherein the alkyl ether is derived from $C_{12-15}$ linear primary alcohol condensed with approximately 3 moles of ethylene oxide.

Suitable nonionic surface active agents include those selected from:

(a) the polyethylene oxide condensates of alkyl phenols, having a straight or branched alkyl of from about 6 to about 12 carbon atoms, with ethylene oxide wherein the amount of ethylene oxide present is from about 3 to about 25 moles per mole of alkyl phenol;

(b) the condensation products of aliphatic alcohols with ethylene oxide of the formula $RO(C_2H_4O)_nH$ wherein R is straight or branched alkyl having from about 8 to about 22 carbon atoms and n is 3 to 40; and (c) polyoxyethylene polyoxypropylene block polymers.

Nonionic surfactants of type (a) above are marketed by GAF Corporation under the trademark Igepal®, e.g., Igepal® CA-420, an octylphenol condensed with an average of 3 moles of ethylene oxide, and by Rohm and Haas under the trademark Triton®, e.g., Triton® X-100, an octylphenol condensed with an average of 9 moles of ethylene oxide.

Nonionic surfactants of type (b) above are marketed by Shell Chemical Company under the trademark Neodol®, e.g., Neodol® 23-6.5, the condensation product of $C_{12-13}$ linear primary alcohol with an average of 7 moles of ethylene oxide, and Neodol 91-8, the condensation product of $C_{9-11}$ linear primary alcohol with an average of 8 moles of ethylene oxide.

Nonionic surfactants of type (c) above are marketed by BASF Wyandotte Corporation under the trademark Pluronic®, e.g., Pluronic® 10 R5 which conforms to the formula $HO(CHCH_3CH_2O)_x(CH_2CH_2O)_y(CHCH_3CH_2O)_zH$ in which the average values of x,y and z are respectively 7, 22 and 7.

Anionic, nonionic, cationic and amphoteric fluorosurfactants which can be employed in the invention are those marketed by E.I. Dupont de Nemours and Company under the trademark Zonyl®, e.g., Zonyl® FSK, an amphoteric fluorosurfactant, Zonyl® FSN, a nonionic fluorosurfactant, Zonyl® FSJ, an anionic fluorosurfactant and Zonyl® FSC, a cationic fluorosurfactant.

Examples of suitable amphoteric surface active agents are sodium 3-(dodecylamino)propionate and sodium 3-(dodecylamino)propane-1-sulfonate.

Surface active agents of the zwitterionic type which are suitable are, for example, 3-(N,N-dimethyl-N-alkylammonio)-2-propane(or hydroxypropane)-1-sulfonates wherein alkyl has from about 12 to about 16 carbon atoms.

The surface active agent is employed in an amount of from about 0.001 to about 1 percent by weight of the three essential components of the composition, preferably from about 0.01 to about 0.5 percent and most preferably from about 0.01 to about 0.25 percent.

Preferably the ratio of surfactant to alcohol is 1:100 to 1:1000.

The water employed in the liquid cleaning composition should be demineralized water. The amount of water employed should be from about 60 to about 99 percent by weight of the three essential components of the liquid cleaning composition, preferably from about 70 to about 90 percent, more preferably from about 75 to 85 percent.

The liquid cleaning composition can, if desired, include other ingredients in small amounts in order to provide additional benefits. Such optional ingredients are, for example, perfumes and fragrances and additional agents for improving soil removal and wetting and surface characteristics. Optional agents which improve soil removal are, for example, glycol ethers such as the methyl and ethyl ethers of ethylene glycol, propylene glycol and dipropylene glycol. Such agents can be included up to about 2 percent by weight of the composition. Optional agents for improving wetting characteristics are, for example, low molecular weight glycols such as ethylene glycol, propylene glycol and dipropylene glycol which can be employed in amounts up to about 1 percent by weight of the composition. Optional agents for improving surface characteristics are film forming agents such as the partially esterified resins described in U.S. Pat. No. 4,448,704 incorporated herein by reference. Such agents can be employed in amounts up to about 1 percent by weight of the composition.

In order to provide satisfactory streak-free cleaning of hard surfaces, the flexible substrate should not be overloaded with the liquid cleaning composition. Overloading will result in an excessive amount of the liquid cleaning composition remaining on the hard surface thus leading to streaking. Underloading should also be avoided because this will result in poor economy since the wipe will not clean as much surface area as a properly loaded wipe.

Proper loading of the flexible substrate with the liquid cleaning composition of the invention is a function of the percentage of pulp in the flexible substrate and should be in the range of about 250 to about 450 percent of the weight of the wood pulp fibers, preferably from about 320 to about 420 percent and most preferably from about 350 to about 390 percent. Thus, with respect to the modified Sontara® 8801 nonwoven material described hereinbefore, this would translate respectively to from about 150 to about 270 percent of the weight of that material, preferably from about 190 to about 250 percent and most preferably from about 210 to about 235 percent.

The pre-moistened wipes of the invention should be packaged in a manner which will maintain them in a moist condition. A variety of well known packaging methods are available. For example, they may be individually packaged in moisture impervious envelopes or packaged in bulk form in cannisters provided with suitable dispensing openings. When packaged in bulk form they may be provided as separate sheets, e.g., in interleaved form, or in the form of interconnected sheets from which individual sheets readily may be separated. In the latter case, reference is made to U.S. Pat. No. 4,017,002.

Cleaning of soiled hard surface is accomplished by wiping the surface with the pre-moistened wipe, using a gentle stroke on the last pass. The surface then is allowed to air dry whereupon a clear, substantially streak-free and lint-free finish will result. The premoistened wipe can be effectively used until dry and therefore may be stored for a limited time, e.g., two weeks, for reuse if still moist on completion of a particular cleaning operation.

The invention is illustrated by the following examples without, however, being limited thereto.

EXAMPLE 1

A liquid cleaning composition was formulated as follows:

| Component | % by weight |
|---|---|
| Anhydrous Ethanol | 22.00 |
| Anionic Surfactant[a] | 0.06 |
| Fragrance | 0.02 |
| Demineralized Water | 77.92 |
| | 100.00 |

-continued

| Component | % by weight |
|---|---|
| Surface tension: 38 dynes/cm | |

[a]Sodium salt of a sulfated polyethylene glycol ether of a mixture of synthetic $C_{12-15}$ fatty alcohols of formula $R(OCH_2CH_2)_nOSO_3Na$, where R represents $C_{12-15}$ fatty alcohol and n has an average value between 1 and 4; marketed as Neodol ® 25-3S (60% active) by Shell Chemical Company.

A flexible nonwoven sheet-like substrate having dimensions of 10"×7½" was impregnated with the above described liquid cleaning composition at a loading of 2.2 g of the composition per gram of substrate (220% of the substrate weight and approx. 367% of the weight of the wood pulp fibers). The substrate employed was a modified Sontara ® 8801, as hereinbefore described, which had been treated with EMULSION E-940 so as to provide a solids add-on after curing of 0.92% by weight of the untreated substrate. The resulting wipe cleaned soiled hard surfaces, e.g., glass, to a clear, shiny substantially streak-free and lint-free finish. The wipe cleaned approximately 30 to 40 square feet of hard surface before exhaustion of the liquid cleaning composition.

EXAMPLE 2

A liquid cleaning composition was formulated as follows:

| Component | % by weight |
|---|---|
| Ethanol (95%) | 20.0000 |
| Ammonium Laureth Sulfate[a] | 0.0150 |
| Propylene Glycol Monomethyl Ether | 1.0000 |
| Fragrance | 0.0125 |
| Demineralized Water | 78.9725 |
| | 100.0000 |
| Surface tension: 36 dynes/cm | |

[a]Ammonium salt of ethoxylated lauryl sulfate wherein the number of ethoxyl groups is between 1 to 4; Richonol ® S-1300C (30% active) obtained from The Richardson Company.

A flexible nonwoven sheet-like substrate was impregnated with the above liquid cleaning composition at a loading of 2.2 g of the composition per gram of substrate. The substrate employed was a modified Sontara ® 8801 as described hereinbefore which had been treated with EMULSION E-940 so as to provide a solids add-on after curing of 1.3% by weight of the modified Sontara ® 8801.

EXAMPLE 3

WIPE C

A wipe was prepared as for WIPE B of EXAMPLE 2 with the exception that RHOPLEX ® TR-934 was substituted for EMULSION E-940.

Wipes B and C according to the invention were compared with a wipe (WIPE D) which had not been treated with an acrylic polymer emulsion in a linting test and a streaking test.

In WIPE D the substrate was Sontara ® 8801 differing from the modified Sontara ® 8801 described hereinbefore only in that the base weight is 2 oz/yd$^2$. The Sontara ® 8801 was impregnated with the liquid cleaning composition of EXAMPLE 2 at a loading of 2.2 g of the composition per gram of substrate.

The linting and streak test procedures were as follows:

In both the linting and streaking procedures ¼" thick glass panels were utilized, each 36"×16" (about 4 sq.

ft.). The panels were spray painted black on one surface thereof followed by polyurethane spraying to preserve the coat of black paint.

LINTING TEST PROCEDURE

The wipe is tested two days after substrate loading with the liquid cleaning composition the wipe being stored after loading in a container which maintains the moist condition of the wipe. The glass panel is cleaned to a lint-free condition with 10% ethanol in demineralized water followed by demineralized water only using paper towels and all the residual lint is then removed by gentle blowing. The cleaned glass panel is wiped 100 times using 30 inch strokes (50 strokes back and forth). At the conclusion of the wiping operation the glass panel is allowed to air dry and lint accumulation thereon then is visually evaluated and rated on a scale of 0 to 6.

STREAKING TEST PROCEDURE

The glass panel is cleaned to a streak-free condition with 10% ethanol in demineralized water followed by demineralized water only using paper towels. The entire surface of each of two cleaned glass panels is then wiped once horizontally across the width of the panel with the same wipe and allowed to air dry. The glass panels then are visually evaluated for spotting and streaking and rated on a scale of 0 to 6.

RATING SCALE FOR LINTING AND STREAKING

| Linting/Streaking | Value |
|---|---|
| None | 0 |
| Very Low | 1 |
| Low | 2 |
| Low-Medium | 3 |
| Medium | 4 |
| Medium-High | 5 |
| High | 6 |

WIPE B, WIPE C and comparative WIPE D (not treated with acrylic polymer emulsion) gave the following results in the above-described linting and streaking test procedures:

| WIPE | VALUE | |
|---|---|---|
| | Linting | Streaking |
| B | 0 | 1 |
| C | 0 | 1 |
| D | 6 | 0 |

From the above results it will be seen that no linting was observed for WIPES B and C according to the invention whereas high linting was observed for WIPE D which had not been treated in accordance with the invention with acrylic polymer emulsion. On the other hand, WIPES B and C caused only very low (but acceptable) streaking as a result of the acrylic polymer emulsion treatment.

What is claimed is:

1. A pre-moistened wipe for cleaning a hard surface to a shiny, substantially streak-free and lint-free finish, the pre-moistened wipe comprising a flexible substrate carrying a liquid cleaning composition wherein:

(a) the flexible substrate comprises a mechanically bonded nonwoven fabric comprising from about 30 to about 60 percent by weight of wood pulp fibers and from about 70 to about 40 percent by weight of synthetic fibers and having incorporated therein a hydrophobic or slightly hydrophobic acrylic polymer having a $T_{300}$ of less than 0° C.;

(b) the liquid cleaning composition has a surface tension of less than 40 dynes/cm and comprises from about 0.001 to about 1 percent by weight of a surface active agent, from about 1 to about 40 percent by weight of a monohydric aliphatic alcohol having from 1 to 6 carbon atoms, and from about 60 to about 99 percent by weight of demineralized water; and (c) the amount of acrylic polymer incorporated in the nonwoven fabric is from about 0.225 to about 2.25 percent by weight of the nonwoven fabric.

2. The wipe according to claim 1 wherein the acrylic polymer has a $T_{300}$ of less than 0° C.

3. The wipe according to claim 1 wherein the nonwoven fabric has a base weight of from about 1.6 oz to about 3.0 oz per square yard.

4. The wipe according to claim 1 wherein the alcohol in the liquid cleaning composition is methanol, ethanol or isopropanol.

5. The wipe according to claim 1 wherein the loading of the liquid cleaning composition onto the substrate is from about 250% to about 450% of the weight of the wood pulp fibers.

6. The wipe according to claim 1 wherein the synthetic fibers are polyester fibers.

7. The wipe according to claim 1 wherein the nonwoven fabric comprises about 60% by weight of wood pulp fibers and about 40% by weight of polyester fibers.

8. The wipe according to claim 7 wherein the base weight of the nonwoven fabric is from about 1.6 oz to about 3 oz per square yard and the loading of the liquid cleaning composition onto the substrate is from about 250% to about 450% of the weight of the wood pulp fibers.

9. The wipe according to claim 8 wherein the base weight of the nonwoven fabric is about 1.85 oz per square yard, the alcohol is ethanol and the surface active agent is anionic.

10. The wipe according to claim 9 wherein the surface active agent is an alkyl ether sulfate of the formula $RO(C_2H_4O)_nSO_3M$ wherein R is alkyl or alkenyl having from about 10 to about 20 carbon atoms, n is 1 to 30 and M is a water-soluble cation.

11. The wipe according to claim 10 wherein the liquid cleaning composition comprises about 22% by weight of ethanol, about 0.06% by weight of surface active agent and the remainder to 100% by weight demineralized water; R represents $C_{12-15}$ fatty alcohol, n has an average value between 1 and 4 and M is sodium.

12. The wipe according to claim 11 wherein the loading of the liquid cleaning composition onto the substrate is about 367% of the weight of the wood pulp fibers.

13. The wipe according to claim 10 wherein the liquid cleaning composition comprises about 19% by weight of ethanol, about 0.0150% aby weight of ammonium laureth sulfate, about 1% by weight of propylene glycol monomethyl ether and the remainder to 100% by weight demineralized water.

14. The wipe according to claim 13 wherein the loading of the liquid cleaning composition onto the substrate is about 367% of the weight of the wood pulp fibers.

* * * * *

UNITED STATES PATENT AND TRADEMARK OFFICE

CERTIFICATE OF CORRECTION

PATENT NO. : 4,666,621

DATED : May 19, 1987

INVENTOR(S) : William A. Clark and David Pregozen

It is certified that error appears in the above-identified patent and that said Letters Patent is hereby corrected as shown below:

Column 1, line 63, "Nm-1" should read -- $Nm^{-1}$ --.

Column 8, line after EXAMPLE 2, should read Wipe B.

Signed and Sealed this

Twenty-sixth Day of April, 1988

*Attest:*

DONALD J. QUIGG

*Attesting Officer*

*Commissioner of Patents and Trademarks*